US005507575A

United States Patent [19]

Rossetti

[11] Patent Number: 5,507,575

[45] Date of Patent: Apr. 16, 1996

[54] AGITATOR HAVING A ROTATIONAL-ORBITAL MOVEMENT FOR MIXING OR BLENDING VARIOUS PRODUCTS

[75] Inventor: Edoardo Rossetti, Finale Emilia, Italy, Finale Emilia

[73] Assignee: COROB S.r.l., Medolla, Italy

[21] Appl. No.: 216,455

[22] Filed: Mar. 23, 1994

[30] Foreign Application Priority Data

Mar. 25, 1993 [IT] Italy ..... BO93A0114

[51] Int. Cl.[6] ..... B01F 11/00

[52] U.S. Cl. ..... 366/217; 366/605

[58] Field of Search ..... 366/110, 111, 366/128, 208, 209, 210, 211–217, 605

[56] References Cited

U.S. PATENT DOCUMENTS

| | | | |
|---|---|---|---|
| 3,706,443 | 12/1972 | Oberhauser | 366/216 |
| 4,134,689 | 1/1979 | Ahrenskou-Sorensen | 366/110 |
| 4,789,245 | 12/1988 | Morbeck | 366/605 X |
| 4,842,415 | 6/1989 | Cane et al. | 366/605 X |
| 5,066,136 | 11/1991 | Johnson | 366/605 X |
| 5,261,744 | 11/1993 | Brunn | 366/217 |
| 5,268,620 | 12/1993 | Hellenberg | 366/209 X |

FOREIGN PATENT DOCUMENTS

| | | | |
|---|---|---|---|
| 9108045 | 6/1991 | WIPO | 366/605 |

*Primary Examiner*—Charles E. Cooley
*Attorney, Agent, or Firm*—Sughrue, Mion, Zinn, Macpeak & Seas

[57] ABSTRACT

An agitator for mixing or blending various products, in particular paints, varnishes or the like, disposed in a container, has a fixed support structure which is resiliently connected to a first framework which in turn supports a second framework in a generally oscillatory manner. An upper plate and a lower plate, rotatable about a vertical axis and mounted on the second framework, hold the container. When the machine is in use, an electric motor, mounted on the first framework, rotates a shaft provided with pins which are eccentric relative to the axis of rotation of the shaft and are connected to the second framework. The actuation of the motor gives rise to an orbital oscillatory motion of both frameworks together and the intermittent and unidirectional rotation of the lower plate about a substantially vertical axis. This promotes quick and homogeneous mixing of paints, varnishes or other such products in a broad range of quantities. Also, the agitator can be used by unskilled operators and is simple and inexpensive to produce.

9 Claims, 3 Drawing Sheets

AGITATOR HAVING A ROTATIONAL-ORBITAL MOVEMENT FOR MIXING OR BLENDING VARIOUS PRODUCTS

BACKGROUND OF THE INVENTION

The present invention relates to an agitator for mixing or blending various products.

In particular, the present invention has been developed with respect to agitators for mixing or blending paints, varnishes or the like, generally placed in containers preferably having a substantially cylindrical shape, of the type comprising:

a general support structure;

a first framework resiliently connected to the support structure;

a second framework which is associated with the first framework with a general capacity for relative oscillation;

holding means associated with the second framework for clamping at least one of the containers containing the products to be mixed;

operating means which are further provided for driving an orbital movement of at least part of the second framework relative to a reference axis which is fixed relative to the first framework.

In the current practice for producing a range of paints having, for example, a series of different colour shades, a base paint, generally a white paint, is usually mixed with one or more coloured pigments which are added in proportions such that the desired colour shade is ensured overall when they have been mixed and homogenized with the base paint.

When paints are prepared according to the above mixing methods, it is increasingly necessary to produce different quantities from time to time depending on the demands and immediate needs of the users. In particular, a range of preferred amounts although not limiting, in the preparation of the paints and their mixtures can vary from small fractions of a liter to approximately 30–40 liters.

The conventional mixing methods provide for different types of methods and agitators depending on the overall quantity of components to be mixed and their physical and chemical properties. For large amounts of relatively fluid paints, a machine of the type comprising a mechanical stirrer which is immersed in the paint is generally used and, for example, blends the components with a rotary motion. These machines are generally used only in large plants producing large amounts of paints since they do not allow the colour shade to be changed quickly without the entire stirrer being replaced, an operation which is generally complicated and expensive, especially for small amounts of paint in a broad spectrum of colours.

For viscous, heavy and dense products and for medium-large amounts, apparatus with a gyroscopic effect are used in which the container for the paint to be blended is rotated about at least one axis. These machines are quite bulky and heavy and have long mixing times because the forces of inertia derived from the gyroscopic movement and from the masses involved increase when the amount of paint blended increases.

For small or very small amounts, mixing is usually carried out manually which, in addition to involving long operating times, does not guarantee a satisfactory result in terms of homogeneity of the paint.

SUMMARY OF THE INVENTION

The object of the present invention is to overcome the disadvantages of the prior art and in particular to provide an agitator which is simple and cheap to produce, which can also be used by unskilled users, and which permits quick and homogeneous mixing in a broad range of different amounts of products.

A further object of the present invention is to produce a stable machine which does not transmit undesired vibrations to the environment and to the surrounding area, and which restricts the energy consumption required for its operation to a minimum.

These objects are achieved by an agitator of the type mentioned above, characterised in that the holding means comprise a drive unit which imparts to the container a general rotational movement about a second axis, different from the reference axis, which is superimposed on the orbital movement.

BRIEF DESCRIPTION OF THE DRAWINGS

Further characteristics and advantages will become clear from the following description, with reference to the appended drawings, given by way of non-limiting example, in which.

DETAILED DESCRIPTION OF THE INVENTION

Figure 1:
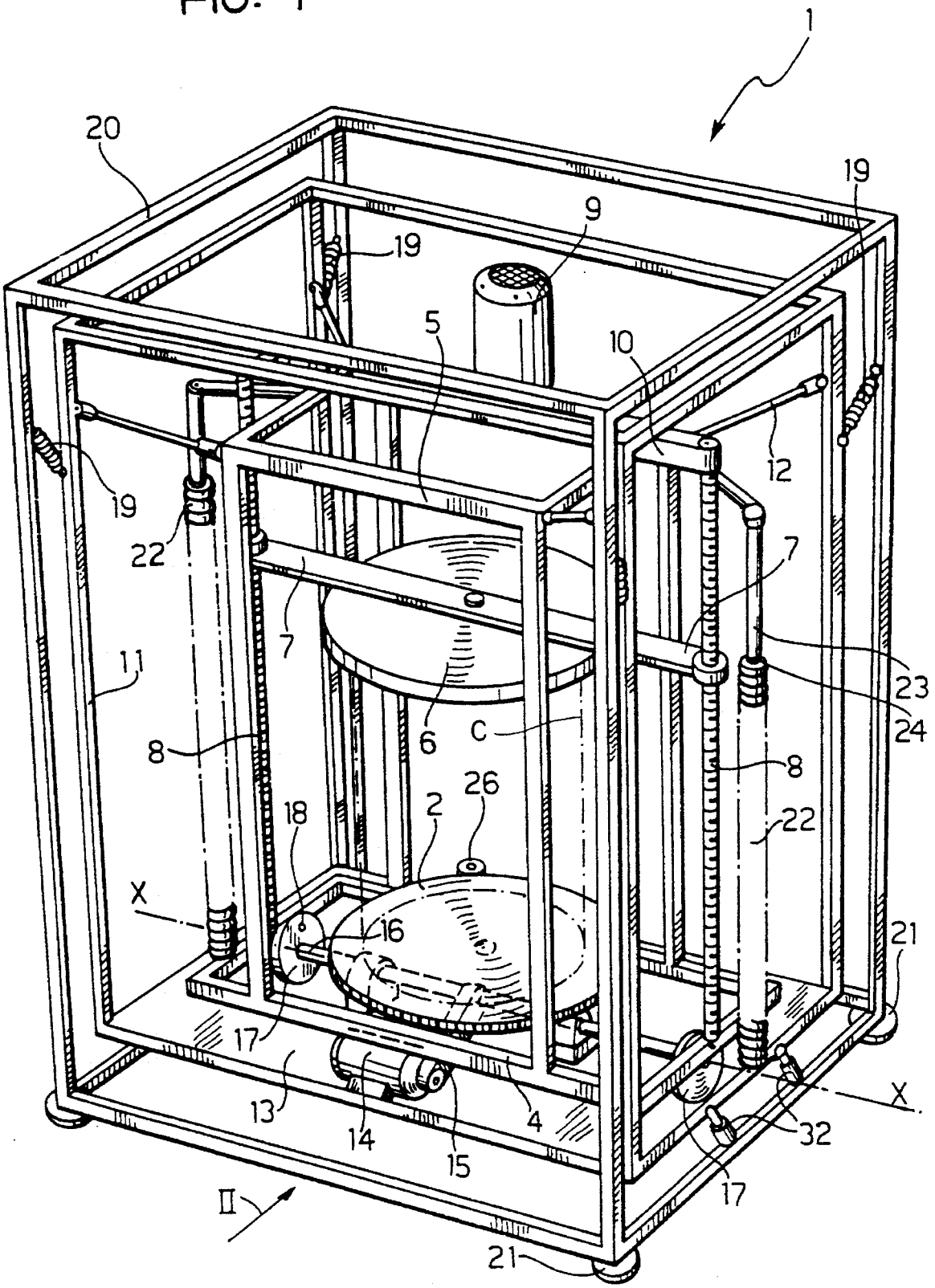
FIG. 1 a schematic view in perspective of an agitator according to the present invention.
Figure 2:
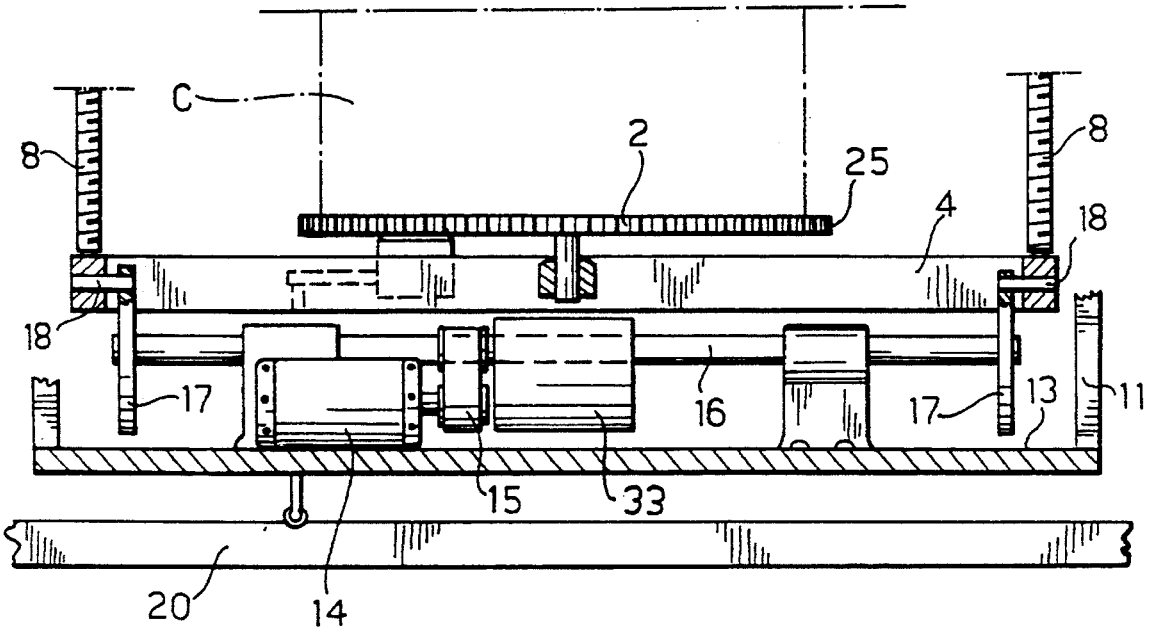
FIG. 2 is a partial schematic front view in the direction of the arrow II of FIG. 1.
Figure 3:
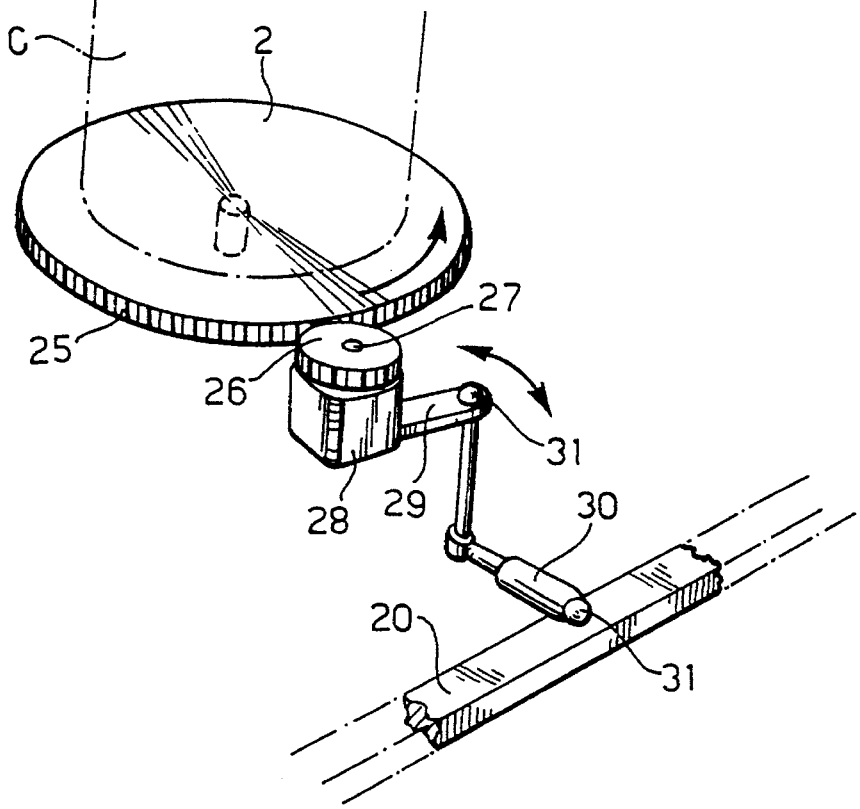
FIG. 3 is a perspective view of a detail of the agitator of FIG. 1.
Figure 4:
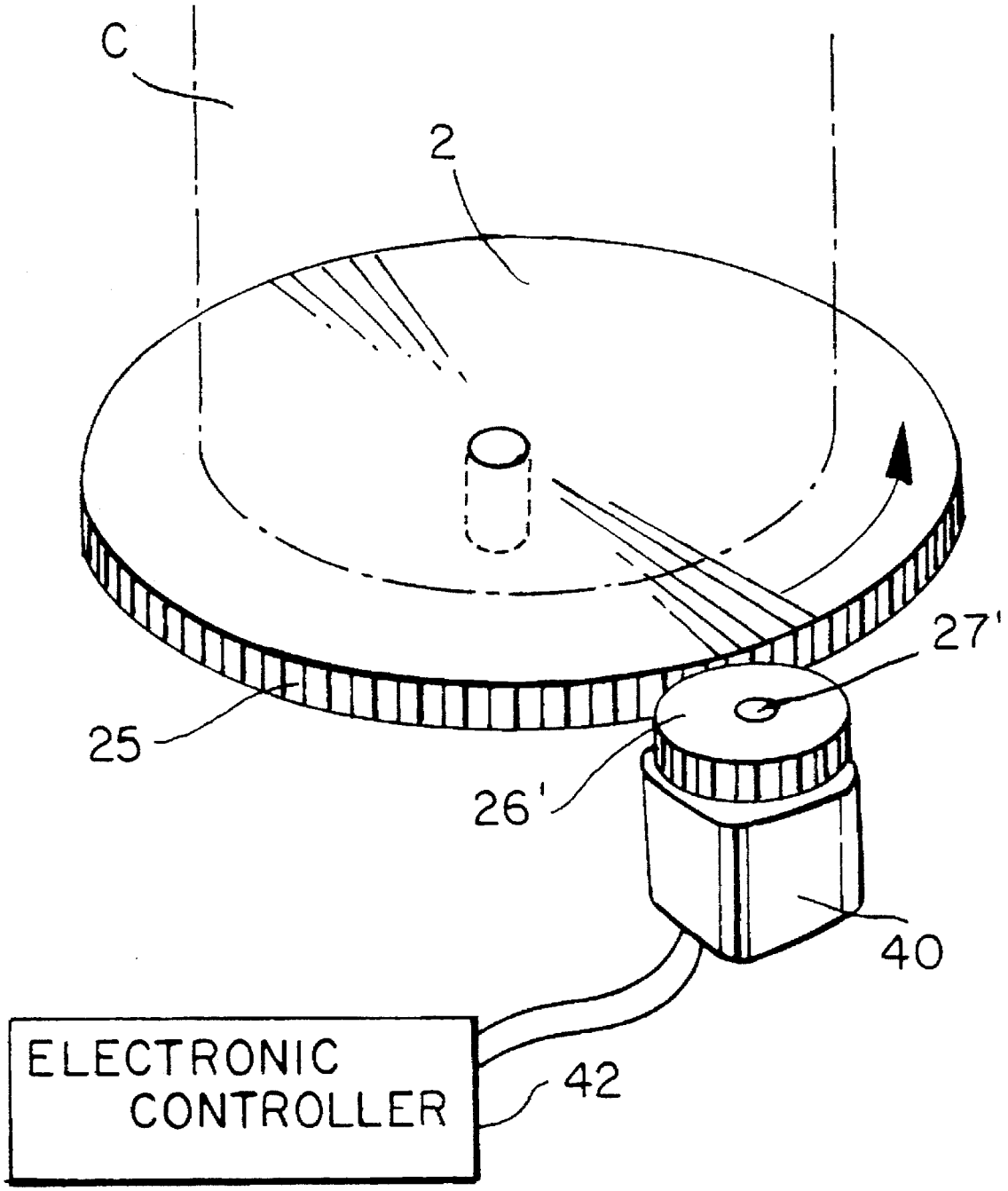
FIG. 4 is a perspective view similar to FIG. 3 showing a modified drive for the plate element 2.

With reference to FIG. 1, an agitator for mixing or blending various products, in particular paints, varnishes or the like, in a container C, shown in chain outline in FIG. 1, is generally indicated 1.

The container C rests on a lower plate element 2 rotatably mounted on a base 4 which is an integral part of a framework 5. The container C is closed at the top by an upper plate 6 rotatably mounted on a structure having appendages 7 with threaded bushes at their ends which engage worm screws 8 extending vertically and rotating relative to the platform 4. An electric motor 9 is mounted on the framework 5 and rotates the upper ends of the worm screws 8 by means of a toothed belt 10 and a pulley transmission, such that the upper plate 6 can be raised or lowered. As an alternative to the single toothed belt 10 which is illustrated, two toothed belts may be provided being wound respectively around one pulley mounted on the output shaft of the electric motor 9 and one pulley mounted on one of the worm screws 8, so as to equally balance the torque of the electric motor 9 applied to both the worm screws 8.

The framework 5 is connected in an oscillatory manner to an outer framework 11 by connecting rods 12 which allow the upper portion of the framework 11 to oscillate relative to the upper portion of the framework 5.

The outer framework 11 comprises a platform 13 on which an electric motor 14 is mounted which, by means of a toothed belt 15 and a pulley system, rotates a shaft 16 mounted for rotation about an axis X-X which is fixed relative to the framework 11. Two discs 17, which bear two pins 18 which are eccentric relative to the axis X-X of the shaft 16, are keyed to the ends of the shaft 16. The pins 18 are rotatably connected to the base 4 of the framework 5. A counterweight 33 is fixed on the shaft 16.

The framework 11 is suspended by means of a system of springs 19 from a support structure 20 provided with support feet 21 which may be vertically adjustable. The framework 11 also has anti-oscillation brakes 32, for example of the friction type, coupled to the support structure 20.

A system of suspension springs 22 associated with respective bars 23 and held in compression by stops 24 mounted on the bars 23 is interposed between the framework 5 and the outer framework 11. The function of these springs 22 is to discharge some of the weight of the container C from the framework 5 to the framework 11.

The lower plate 2 is circular and has a toothed rim 25, preferably with straight or helical teeth, on its cylindrical peripheral surface.

This toothed rim 25 is coupled to a pinion 26 rotated by means of a pin 27, by a ratchet unit 28 which is in turn coupled to a driving lever 29, of which the end opposite the ratchet unit 28 is articulated to the support structure 20 by a telescopic joint 30. The two ends of the joint 30 have ball joints 31 connected to the driving lever 29 and to the support structure 20 respectively.

When the agitator according to the present invention is in operation, the container C containing the various products to be blended is loaded onto the lower plate 2. The electric motor 9 is actuated to rotate the worm screws 8 by means of the belt 10, causing the upper plate 6 to descend, which clamps the container C onto the lower plate 2.

The electric motor 14 is then activated and, by means of the belt 15, rotates the shaft 16 about the axis X-X, thus causing the framework 5 to rotate eccentrically with an orbital-oscillatory motion about the axis X-X by means of the pins 18.

The overall oscillation of the two frameworks 5, 11 is at least partially counterbalanced by their own weight and by the counterweight 33. This oscillation relative to the fixed support structure 20 gives rise to an alternating relative oscillation of the driving level 29 with respect to the support structure 20. This oscillation drives into rotation the ratchet device 28 which imparts a unidirectional and intermittent rotary motion to the lower plate 25 by means of the toothed wheel 26.

After the electric motor 14 has been activated for a given amount of time, during which the agitator mixes the products in the container C, this motor is deactivated and the oscillatory motion of the frameworks 5 and 11 is braked by the anti-oscillation brakes 32, Subsequently, a rotation is imparted to the worm screws 8 by the actuation of the electric motor 9, in order to raise the upper plate 6 and thus release the container C containing the various blended products.

An alternative to the adoption of the ratchet device 28 for imparting the rotary motion to the lower plate 2 consists of providing the agitator with an auxiliary electric motor 40 which is electronically controlled by an electronic controller 42 and whose output shaft 27' is operatively connected to the pinion 26'. The electronic control of the auxiliary electric motor drives into rotation the pinion 26' according to a selectively predetermined law which may be for example a unidirectional and intermittent rotary motion, as the one accomplished by the ratchet device 28 described above, or, more generally a unidirectional or bidirectional rotary motion, either intermittent or continuous.

Moreover, a further alternative embodiment of the invention disclosed in the present specification provides for an idle lower plate and an upper plate which is driven into rotation by a drive unit, either in the form of the ratchet device 28 or of the auxiliary electric motor hereinabove mentioned. This embodiment allows the lower plate to be slidably mounted on guide rails or similar supporting elements so as to be extracted at least partially from the support structure of the agitator for simplifying the operation of loading and unloading thereof, Naturally, the principle of the invention remaining the same, the forms of embodiment and details of production can be widely varied with respect to what has been described and illustrated without departing from the scope of the present invention.

What is claimed is:

1. An agitator for mixing or blending products, the agitator comprising:

a support structure;

a first framework resiliently connected to the support structure, the first framework defining a frame of reference including a reference axis;

a second framework movably connected to the first framework for oscillation relative to the first framework;

holding means mounted in the second framework for holding at least one container containing products to be mixed; and operating means for driving at least a portion of the second framework in orbital movement relative to said reference axis, wherein said holding means comprises an axis of rotation which is non-coincident with said reference axis and a drive means for imparting rotational movement to said holding means and said at least one container held by the holding means about said axis of rotation, whereby a rotational movement of said at least one container about said axis of rotation is superimposed on said orbital movement.

2. An agitator according to claim 1, wherein the holding means comprises a first plate element rotatably mounted on the second framework, and the drive means comprises toothed transmission means disposed on said first plate element and a pinion coupled to said toothed transmission means.

3. An agitator according to claim 2, wherein said first plate element has at least one substantially cylindrical portion and said toothed transmission means comprises a plurality of teeth on said at least one cylindrical portion of said first plate element in engagement with said pinion; said drive means further comprising:

a ratchet unit connected with said pinion; and a driving lever articulated to the support structure and operatively connected to the ratchet unit for driving the pinion and hence the first plate element in intermittent and unidirectional rotation.

4. An agitator according to claim 2, wherein said drive means further comprises:

an auxiliary electric motor coupled to said pinion; and control means to drive the auxiliary electric motor and hence the pinion element and the first plate element into rotation.

5. An agitator according to claim 2, wherein said holding means comprises a second idle plate element rotatably mounted on the second framework, said first and second plate elements cooperating, in use, for supporting and clamping said at least one container containing products to be mixed.

6. An agitator according to claim 5, wherein said second idle plate element is disposed above the first plate element and further comprising guide means mounted on said second framework and connected to the second plate element for moving the second plate element toward and away form the first plate element for clamping and unclamping said at least one container.

7. An agitator according to claim 1, wherein the holding means comprises at least one first holding element, a second holding element and additional drive means for moving said second holding element selectively toward and away from said at least one first holding element.

8. An agitator according to claim 7 wherein worm screws are mounted on said second framework and the second holding element includes appendages threadedly engaged with respective said worm screws, said additional drive means selectively rotating said worm screws to move said second holding element toward and away from said first holding element.

9. An agitator according to claim 1, further comprising a shaft rotatably supported by the first framework and at least one motor operatively connected with said shaft, the second framework being coupled eccentrically to said shaft whereby upon rotation of said shaft said second framework undergoes orbital movement relative to the first framework.

* * * * *